US007351028B2

(12) United States Patent
Potter et al.

(10) Patent No.: US 7,351,028 B2
(45) Date of Patent: Apr. 1, 2008

(54) WORK MACHINE ADAPTER AND METHOD

(75) Inventors: David Potter, Sharon, VT (US); Marc D. Curtis, Spencer, MA (US)

(73) Assignee: Lucky Friday Corp., Shrewsbury, MA (US)

( * ) Notice: Subject to any disclaimer, the term of this patent is extended or adjusted under 35 U.S.C. 154(b) by 39 days.

(21) Appl. No.: 11/204,732

(22) Filed: Aug. 16, 2005

(65) Prior Publication Data

US 2006/0182599 A1 Aug. 17, 2006

Related U.S. Application Data

(60) Provisional application No. 60/644,551, filed on Jan. 18, 2005.

(51) Int. Cl.
*E02F 9/00* (2006.01)

(52) U.S. Cl. ..... 414/723; 37/468; 403/348

(58) Field of Classification Search ..... 414/722, 414/723, 725, 726, 729; 108/142; 74/25, 74/56; 37/468; 294/86.41; 403/348, 349
See application file for complete search history.

(56) References Cited

U.S. PATENT DOCUMENTS 3,182,831 A * 5/1965 Bergmann ..... 414/705
4,266,395 A 5/1981 Basham ..... 56/209
4,554,978 A 11/1985 Schneider ..... 172/247
4,787,811 A 11/1988 Langenfeld et al. ..... 414/723
4,948,328 A 8/1990 Busch ..... 414/723
5,082,065 A 1/1992 Fletcher ..... 172/273
5,098,252 A * 3/1992 Sheesley et al. ..... 414/723
5,141,385 A 8/1992 Tibbatts et al. ..... 414/723
5,403,144 A 4/1995 Staben, Jr. ..... 414/697
5,562,398 A * 10/1996 Knutson ..... 414/732
5,938,399 A 8/1999 Knutson ..... 414/722
6,360,459 B1 3/2002 Brookhart et al. ..... 37/442

OTHER PUBLICATIONS

Three digital photographs of adapter apparatus.
Ati Bradco; "Bradco Tilt Attach for Skid-Steer Universal Hitches" brochure 2-Pages.
WOODSSKIDSTER attachments Brochure 8-Pages.
Bradco Mounting Kit Installation sheets #17446 and #87301 (2-sheets).

* cited by examiner

*Primary Examiner*—Donald Underwood
(74) *Attorney, Agent, or Firm*—Nields & Lemack

(57) ABSTRACT

Adapter for mounting on a work machine comprising an attachment for individually attaching one or more working implements to the work machine and allowing lateral rotation or tilting of the working implement, thereby raising one lateral end of the implement while simultaneously lowering the opposite lateral end. The adapter can be permanently mounted to the work machine (and remains dormant when not in use), or can be removably mounted thereto.

13 Claims, 6 Drawing Sheets

WORK MACHINE ADAPTER AND METHOD

This application claims priority of Provisional Ser. No. 60/644,551 filed Jan. 18, 2005, the disclosure of which is hereby incorporated by reference.

BACKGROUND OF THE INVENTION

Various utilitarian implements for powered work machines such as tractors, skid steer loaders, combines, excavating machines, bulldozers, front end loaders, etc. are well known. Typical tasks performed by such work machines include construction, digging, grading, excavating, etc. Exemplary attachments for these vehicles include buckets, scoops, forks, front-end loaders, dozer blades, plows, landscaping implements, trenchers, toothbars, brooms, rakes, tillers, backhoes, and other material-handling and general application tools.

The interchangeability of these implements on a single work machine is generally desirable in order to enhance the versatility of these machines. Accordingly, quick attachment mechanisms for mounting and dismounting such implements have been developed to facilitate this interchangeability.

However, conventional quick attachment designs generally do not allow for the tilting of the implement about a horizontal axis during operation. Such tilting can be desirable, where, for example, the work machine encounters uneven terrain, or where the operation to be carried out by the implement would be facilitated were the implement capable of being tilted. Attachment mechanisms that do allow for tilting suffer from other drawbacks, such as complicated and expensive designs, inability to support heavy loads, etc.

Accordingly, it would be desirable to provide an attachment assembly for work machines that is inexpensive, easy to operate, is a compact and simplified design, and allows for tilting about a longitudinal axis of the work machine to which the implement is attached.

SUMMARY OF THE INVENTION

The problems of the prior art have been overcome by the present invention, which provides an adaptor for mounting on a work machine, the adapter comprising an attachment for individually attaching one or more working implements to the work machine and allowing lateral rotation or tilting of the working implement, thereby raising one lateral end of the implement while simultaneously lowering the opposite lateral end. Preferably the adapter is permanently mounted to the work machine (and remains dormant when not in use), although removable mounting of the adapter is within the scope of the present invention.

In a preferred embodiment, the adapter includes first and second plates, slidable with respect to each other. The first plate is adapted to be mounted to the working machine and remains stationary. The second plate is rotatably mounted to the first plate, and can be rotated in response to a suitable actuator, such as a hydraulic cylinder. The working implement can be mounted to the second plate, which preferably includes a quick attachment configuration for ease of mounting.

The tilting adjustment is particularly useful when the angle of attack of the work implement is not level, or when the angle of attack is level but the grading or other operation requires skewing of the implement.

In certain embodiments, the adapter of the invention can include permanently or removably mounted quick attachment members on its front face, for quick attachment of utilitarian accessories thereto.

Other features and advantages of the invention will become readily apparent upon reference to the following description and drawings.

DETAILED DESCRIPTION OF THE INVENTION

Figure 1:
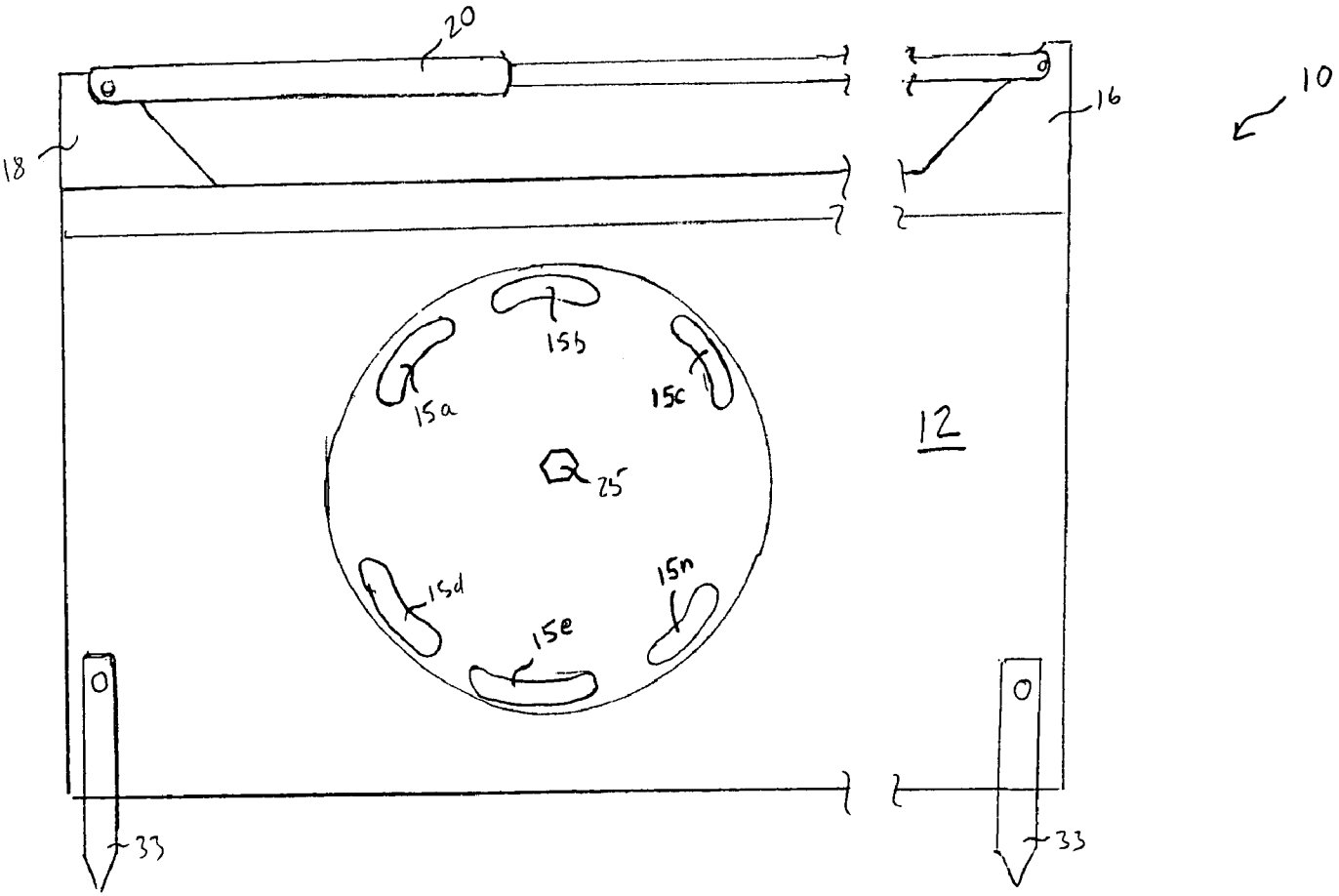
FIG. 1 is a front view of the adapter of the present invention.
Figure 2:
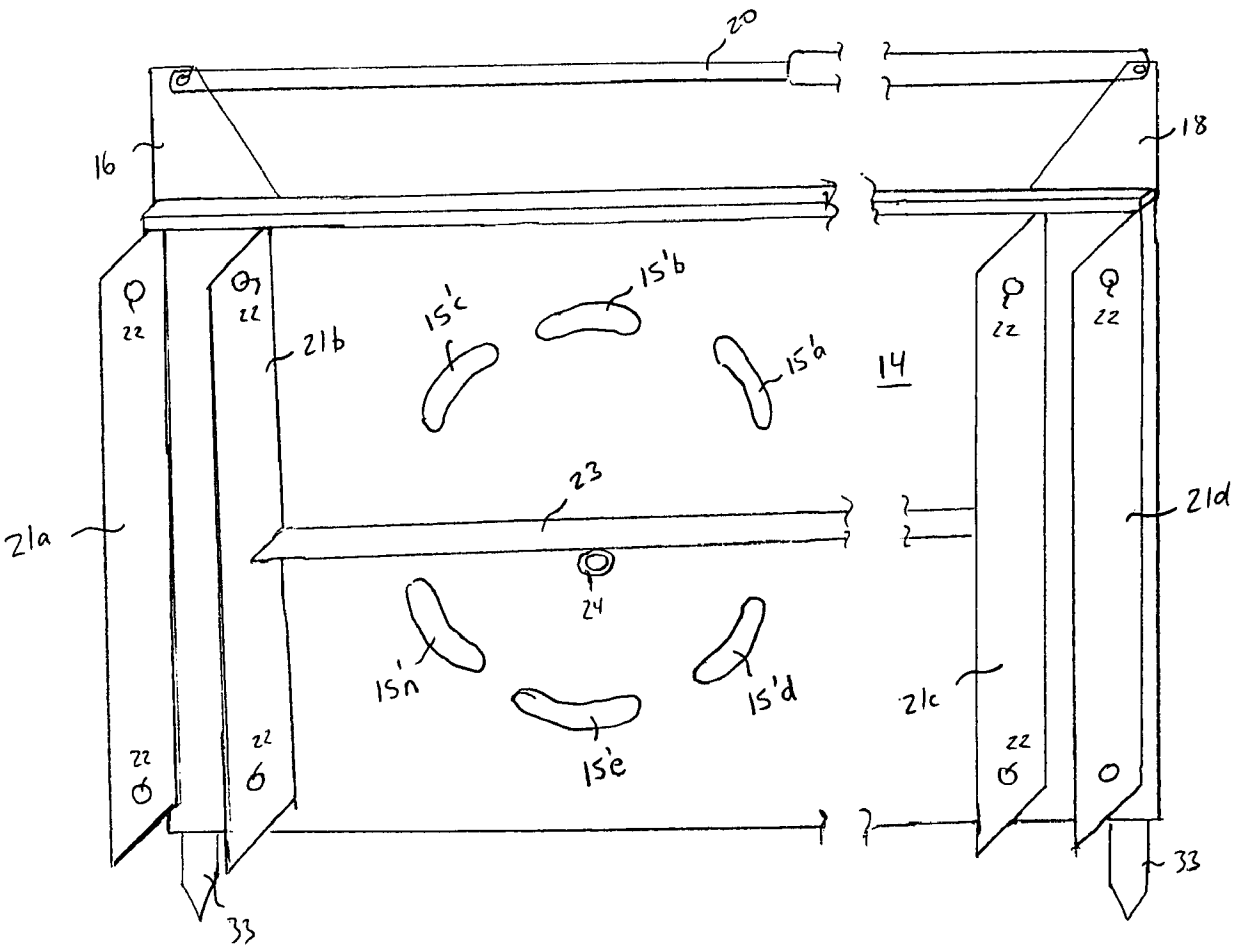
FIG. 2 is a perspective view of the adapter of the present invention.

Turning first to FIG. 1, there is shown the adapter 10 in accordance with a preferred embodiment of the present invention. The adapter 10 is illustrated as a generally rectangular member, and includes a front plate 12 and a rear plate 14 (FIG. 2). Preferably the plates are planar or substantially planar, and are made of a rigid material such as steel, that is capable of withstanding the stresses generally associated with the application. A plurality of apertures such as slots 15*a*-15*n* is formed on the front plate 12. In the embodiment shown, the slots 15*a*-15*n* are configured in an upper array and a lower array, with each array having three slots that are preferably uniformly spaced. Those skilled in the art will appreciate that although six slots are shown (three in each array), the number of slots is not critical. Furthermore, depending upon the application, apertures could be formed closer to the lateral sides of the plate. Preferably the slots 15*a*-15*n* are arcuate in shape, with the length of the slots dictating the degree of rotation of the front plate 12 relative to the rear plate 14, as discussed in greater detail below.

One upper corner of the plate 12 includes an ear 16 that extends upwardly from the plate 12 as shown. The ear 16 allows for attachment of one end of an actuator 20, preferably a hydraulic cylinder. The ear 16 can be an integral part of the plate 12, or can be coupled to the plate by suitable means such as welding.

FIG. 2 illustrates the backside of the adapter 10, and in particular, the rear face of rear plate 14. The rear plate 14 also includes a plurality of apertures or slots 15'*a*-15'*n*, each of which is configured and positioned to register or align with a corresponding slot on plate 12 when plates 12 and 14 are brought into aligning engagement. The upper corner of the plate 14 opposite ear 16 on plate 12 includes an ear 18 that projects upwardly from the plate 14 as shown. The ear 18 allows for attachment of one end of an actuator 20, preferably a hydraulic cylinder. The ear 18 can be an integral part of the plate 14, or can be coupled to the plate by suitable means such as welding.

Figure 6:
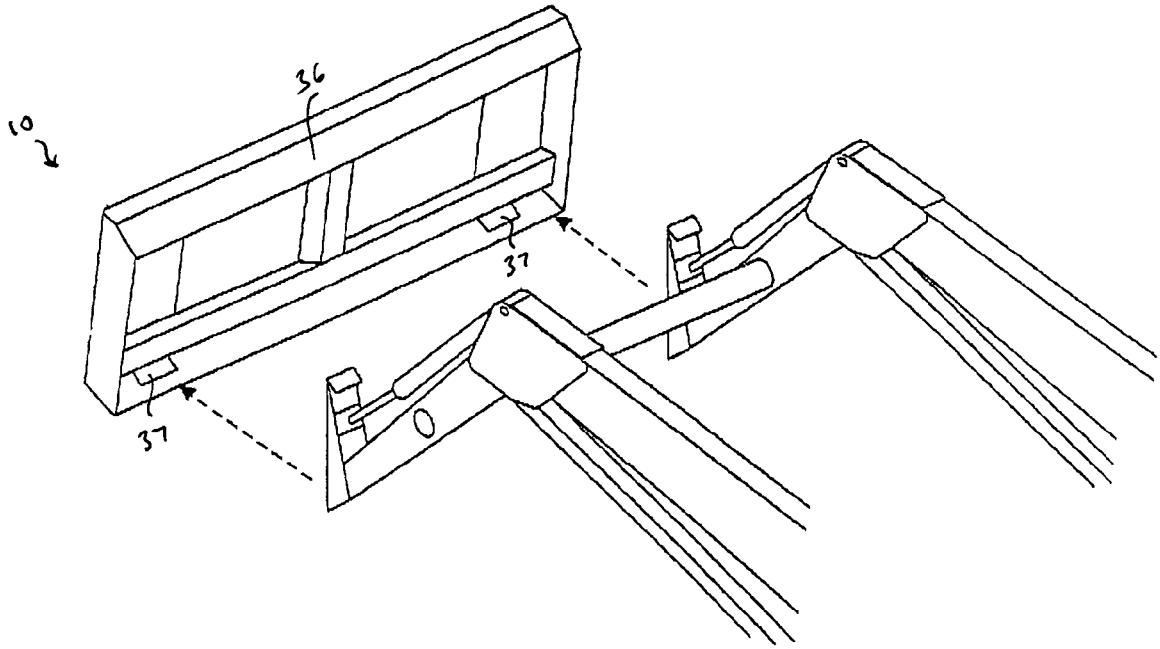
FIG. 6 is a perspective view of the adapter configured to receive a conventional quick attach assembly.

The rear plate 14 also includes various longitudinal brackets 21*a*-21*d* that provide stability to the adapter and also provide a means for connecting the adapter to the work machine. For example, holes 22 can be provided in the brackets that accommodate pins, bolts or the like for securing the adapter to the work machine. Alternatively, the plate 12 can be configured to receive a conventional quick attach member or members (FIG. 6). For example, an upper soffit 36 or the like can receive forks or other conventional male quick attach members typically found on a skidsteer or tractor, and spikes can be actuated to insert into lower slots 37 to secure the adapter on the working implement.

Figure 3B:
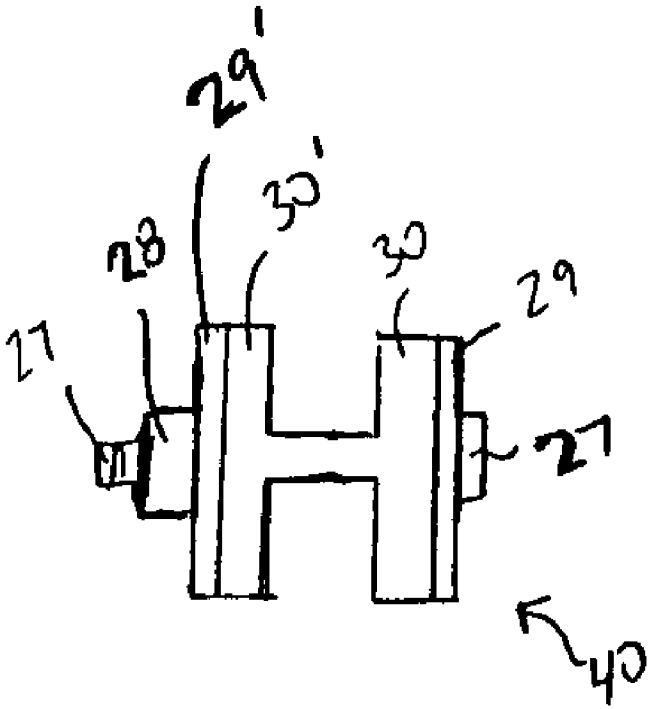
FIG. 3B is a cross-sectional view of the bolt assembly shown in FIG. 3A.
Figure 3A:
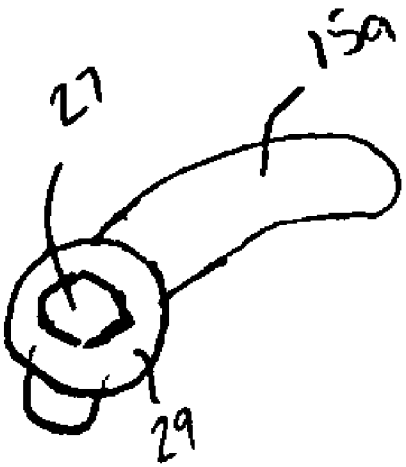
FIG. 3A is a front view of a adapter front plate slot with a bolt assembly in the slot.

The front plate 12 and the rear plate 14 are placed in aligning engagement, such that each of the slots formed in the front plate 12 register with a corresponding slot in the rear plate 14. The plates can be secured in alignment such as with nut and bolt 24, 25. In addition, nuts and bolt assemblies 40 or the like are placed in each of the aligned slots, preferably with suitable bushings and washers, as shown in FIGS. 3A and 3B. Specifically, using slots 15*a* and 15*a*' for purposes of illustration, a bolt 27 projects through slots 15*a* and 15*a*' and is secured by nut 28. A washer 29 and bushing 30 are preferably used on each side, with one bushing 30 abutting against the face of front plate 12 and the other bushing 30' abutting against the rear face of rear plate 14 to facilitate the relative movement between the plates. If additional support and integrity is desired or necessary, a plate or disk can be attached to each bolt assembly to help dissipate the stresses encountered during movement of the plates. In addition, one or more slots can be formed near the lateral edges of the plates, such as between brackets 21*a* and 21*b* and between brackets 21*c* and 21*d* for added strength.

Figure 4:
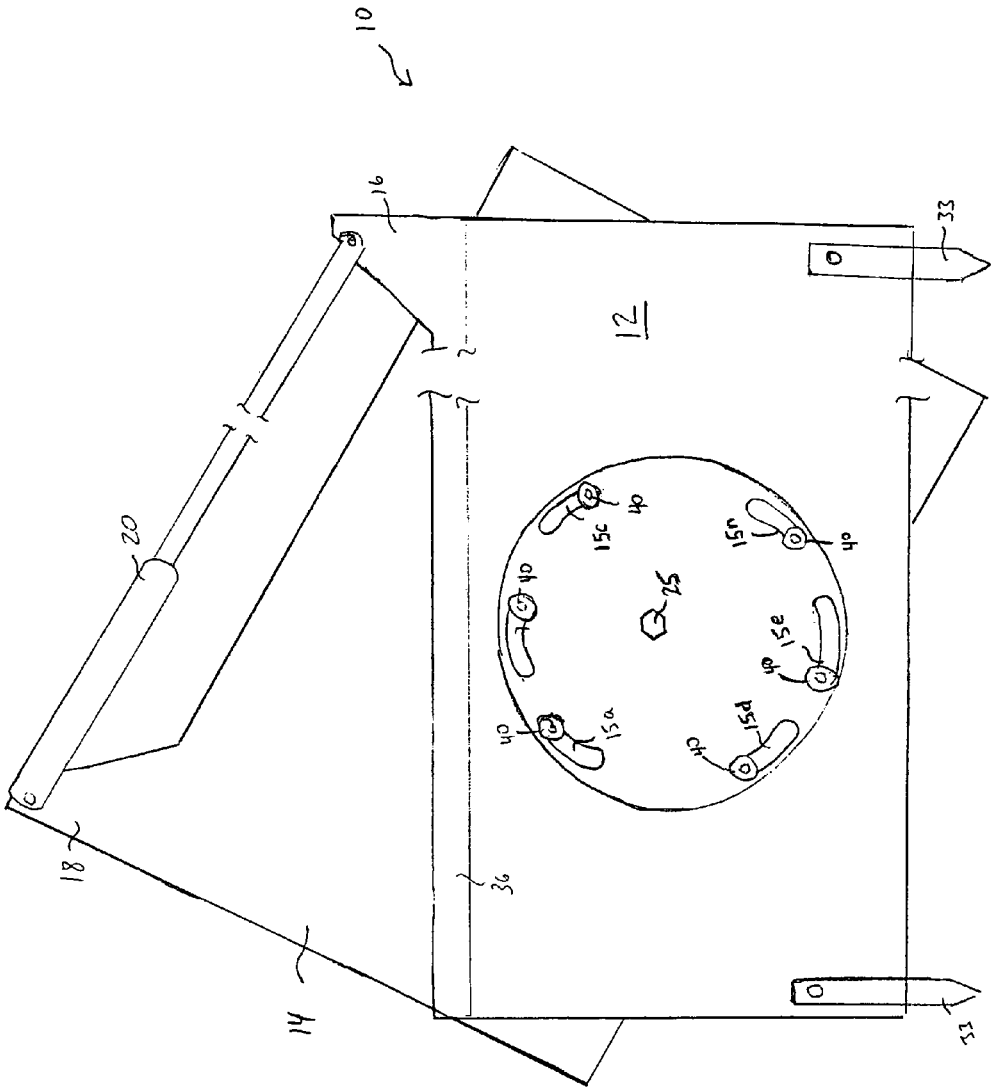
FIG. 4 is a front view of the adapter in a tilted position.

The bolt assemblies 40 described above help maintain the plates in aligning engagement, and also provide stops that limit the extent of the rotation of one plate relative to another. For example, with reference to FIG. 4, the plates 12 and 14 are shown in a tilted configuration, wherein the bolt assemblies 40 in the top array of the slots in the top plate 12 are positioned in the far right portion of the slots, and the bolt assemblies 40 in the lower array of slots in the top plate 12 are positioned in the far left portion of the slots, each preventing further relative rotation of the plates.

Those skilled in the art will appreciate that the length of the slots on either the plate 12 or the plate 14 will dictate the maximum relative rotation possible. Preferably the slots are of such a length that a relative rotation of from about 15-25°, preferably about 18-20° is possible.

Preferably the relative rotation is in response to an actuator, such as a hydraulic cylinder 20. Since upon rotation to the position shown in FIG. 4, the respective ears 16, 18 of the plates are closer than in the neutral position of FIG. 1, one can readily see that the actuator is contracted to create the movement from the neutral position to the tilted position, and expanded to urge the plates back towards their neutral positioning.

The adapter 10 preferably attaches to the working implement with spring-loaded spikes 33 that are coupled to the adapter. The spikes position in slots in the working implement. In addition, working implements generally have a bar or the like that fits under soffit 36 formed on the front plate 12 to further secure the working implement to the adapter 10. A conventional quick attach also can be used to secure the adapter to the working implement, as shown in FIG. 6.

Although the foregoing description describes the adapter 10 as a separate member, it will be understood by those skilled in the art that the adapter can be made as an integral part of the working implement without departing from the spirit and scope of the invention. In addition, the front side of the adapter can itself include male quick attach members so that a utilitarian accessory such as a bucket can be attached to the adaptor. Such an attachment can be permanent or removable. Thus, in certain embodiments, two quick attach mechanisms are used; one to attach the adaptor to the working implement, and the other to attach a utilitarian accessory to the adaptor.

Figure 5:
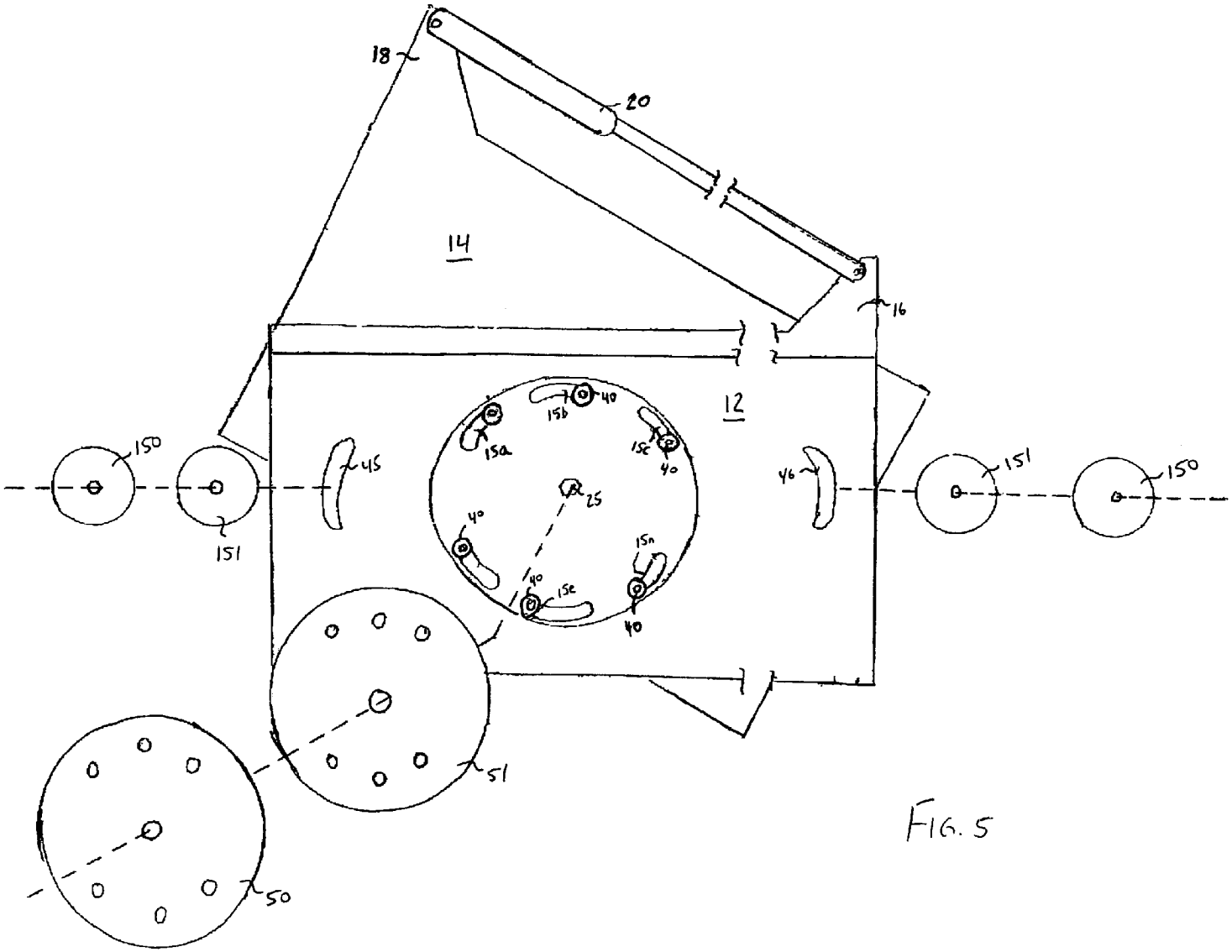
FIG. 5 is a front view of the adapter in a tilted position with the addition of wear plates.

FIG. 5 shows another embodiment of the present invention where one or more lateral slots 45, 46 are positioned near the lateral sides of the plate 12 for added strength. Preferably the lateral slots 45, 46 are arcuate in shape.

FIG. 5 also illustrates optional adjustable wear plates. Specifically, a set of an outer wear plate 50 and inner wear plate 51, each with apertures corresponding to bolts 40 and central aperture 25, can be positioned on the front face of plate 12 and secured with bolts 40. A second set of an outer wear plate and inner wear plate (not shown) is similarly positioned and attached on the rear face of plate 12. Preferably the outer wear plates are made of steel, are about ¼ inch thick, and function to hold the respective inner wear plates in place. The inner wear plates are made of plastic, such as a polyolefin or polyurethane, or preferably nylon, or combinations thereof, and are from about ⅛ to about ¼ inch, preferably about 3⁄16 inches, thick. In the embodiment shown, each has a diameter of about 17 inches. Sets of outer and inner wear plates are similarly secured to the front and rear faces of rear plate 14. Over time, as the inner wear plates wear due to relative movement of the plate 12 and plate 14, the bolts 40 can be tightened to maintain the desired tension and maintain a preload on the plates 12, 14. The wear plates also help prevent dirt and other debris from hindering the relative movement of the plates 12, 14.

Lateral wear plates 150, 151 also can be used at lateral slots 45, 46 as shown. As is with central wear plates 50, 51, the outer lateral wear plates 150 are preferably made of steel and are about ¼ inch thick, and the inner war plates 151 are made of a polyolefin, polyurethane or preferably nylon, and are about 3⁄16 inches thick. In the embodiment shown, the lateral wear plates have a diameter of about four inches.

A similar outer plate/inner wear plate arrangement can be used between plates 12 and 14, if desired.

What is claimed is:

1. An adapter for a work machine for attaching a utility attachment thereto, said adapter comprising:

a first plate having a first plurality of apertures and adapted to attach to said work machine;

a second plate having a second plurality of apertures, said second plate rotatively coupled to said first plate through said first and second pluralities of apertures and adapted to attach to said utility attachment such that both said second plate and said utility attachment are together rotatable relative to said first plate;

an actuator for causing relative rotational movement of said first and second plates;

wherein said first and second pluralities of apertures are slots, and wherein the degree of relative rotation between said plates is dictated by the length of said slots on either said first plate or said second plate.

2. The adapter of claim 1, wherein said apertures are positioned in a circular array.

3. The adapter of claim 1, wherein said actuator comprises a hydraulic cylinder.

4. The adapter of claim 1, further comprising means for receiving a quick attach mechanism attached to said working machine.

5. The adapter of claim 1, further comprising a quick attach mechanism attached to said second plate.

6. The adapter of claim 1, wherein one of said first plurality of apertures is a central aperture.

7. The adapter of claim 1, wherein one of said second plurality of apertures is a central aperture.

8. An adapter for a work machine for attaching a utility attachment thereto, said adapter comprising:

a first plate having a first plurality of apertures and adapted to attach to said work machine;

a second plate having a second plurality of apertures, said second plate rotatively coupled to said first plate through said first and second pluralities of apertures and adapted to attach to said utility attachment such that both said second plate and said utility attachment are together rotatable relative to said first plate;

an actuator for causing relative rotational movement of said first and second plates;

wherein said apertures are positioned in a circular array, said first plate has first and second lateral sides, and further comprising at least one aperture positioned between said circular array and said first lateral side.

9. The adapter of claim 8, further comprising at least one aperture positioned between said circular array and said second lateral side.

10. The adapter of claim 9, wherein said at least one aperture positioned between said circular array and said first lateral side, and said at least one aperture positioned between said circular array and said second lateral side, are arcuate.

11. An adapter for a work machine for attaching a utility attachment thereto, said adapter comprising:

a first plate having a first plurality of apertures and adapted to attach to said work machine;

a second plate having a second plurality of apertures, said second plate rotatively coupled to said first plate through said first and second pluralities of apertures and adapted to attach to said utility attachment such that both said second plate and said utility attachment are together rotatable relative to said first plate;

an actuator for causing relative rotational movement of said first and second plates;

wherein said apertures are positioned in a circular array; and wherein said second plate has first and second lateral sides, and further comprising at least one aperture positioned between said circular array and said first lateral side.

12. The adapter of claim 11, further comprising at least one aperture positioned between said circular array and said second lateral side.

13. The adapter of claim 12, wherein said at least one aperture positioned between said circular array and said first lateral side, and said at least one aperture positioned between said circular array and said second lateral side, are arcuate.

* * * * *